US010808369B2

(12) United States Patent
Tozer

(10) Patent No.: US 10,808,369 B2
(45) Date of Patent: Oct. 20, 2020

(54) DEVICE FOR COLLECTING DEBRIS

(71) Applicant: Aero-Tech Pty Ltd, Nunawading, Victoria (AU)

(72) Inventor: Warwick Tozer, Brighton (AU)

(73) Assignee: AERO-TECH PTY LTD., Nunawading, Victoria (AU)

( * ) Notice: Subject to any disclaimer, the term of this patent is extended or adjusted under 35 U.S.C. 154(b) by 211 days.

(21) Appl. No.: 15/772,387

(22) PCT Filed: Oct. 28, 2016

(86) PCT No.: PCT/AU2016/051015
§ 371 (c)(1),
(2) Date: Apr. 30, 2018

(87) PCT Pub. No.: WO2017/075651
PCT Pub. Date: May 11, 2017

(65) Prior Publication Data

US 2018/0282959 A1 Oct. 4, 2018

(30) Foreign Application Priority Data

Nov. 6, 2015 (AU) ..... 2015904568

(51) Int. Cl.
*E01H 1/04* (2006.01)

(52) U.S. Cl.
CPC ..... *E01H 1/047* (2013.01); *E01H 1/04* (2013.01)

(58) Field of Classification Search
CPC ..... E01H 1/047; E01H 1/04; E01H 1/02
(Continued)

(56) References Cited

U.S. PATENT DOCUMENTS 3,594,844 A * 7/1971 Hargreaves ..... E01H 1/047 15/83
4,317,246 A * 3/1982 Knowlton ..... E01H 1/047 100/233

(Continued)

FOREIGN PATENT DOCUMENTS

WO 96/09440 A1 3/1996
WO 98/29609 A1 7/1998

(Continued)

OTHER PUBLICATIONS

Written Opinion issued by the International Bureau in corresponding International Application No. PCT/AU2016/051015, dated Jan. 13, 2017.

(Continued)

*Primary Examiner* — Weilun Lo
(74) *Attorney, Agent, or Firm* — Sughrue Mion, PLLC

(57) ABSTRACT

A device for collecting debris from a ground surface, comprising a flexible generally planar member with an opening therethrough such that when the device is laid on and moved forwardly over the ground surface debris on the ground surface passes upwardly through the opening onto a collection surface of the device, the device having an inclined surface extending upwardly and rearwardly from a transverse edge which forms a rear edge of the opening, wherein the device further includes at least one longitudinal retaining barrier extending at least partly across the collection surface such that at least part of the debris on the collection surface is retained from transverse movement along the collection surface by the longitudinal retaining barrier.

21 Claims, 5 Drawing Sheets

(58) Field of Classification Search
USPC ..... 15/78
See application file for complete search history.

(56) References Cited

U.S. PATENT DOCUMENTS

| | | | |
|---|---|---|---|
| 4,709,436 | A | 12/1987 | Berfield et al. |
| 5,284,211 | A | 2/1994 | Tozer |
| 6,079,503 | A | 6/2000 | Tozer |
| 8,250,696 | B2 | 8/2012 | Tozer |
| 8,839,878 | B2 | 9/2014 | Tozer |
| 2012/0017939 | A1 | 1/2012 | Davis et al. |

FOREIGN PATENT DOCUMENTS

| | | | |
|---|---|---|---|
| WO | 2005/111312 | A1 | 11/2005 |
| WO | 2009/026624 | A1 | 3/2009 |
| WO | 2010/088715 | A1 | 8/2010 |

OTHER PUBLICATIONS

International Search Report, issued by International Searching Authority in corresponding International Application No. PCT/AU2016/051015, dated Jan. 13, 2017.
Newstripe Inc., Drag King Baseball Field Drag Models 10001665 & 10001592, Jan. 2014, <URL: https://www.flipsnack.com/Newstripe/drag-king-with-infield-drag.html> (2 pages total).

* cited by examiner

DEVICE FOR COLLECTING DEBRIS

CROSS REFERENCE TO RELATED APPLICATIONS

This application is a National Stage of International Application No. PCT/AU2016/051015, filed Oct. 28, 2016, claiming priority based on Australian Patent Application No. 2015904568, filed Nov. 6, 2015.

FIELD OF THE INVENTION

This invention relates to a device for the collection of debris. More particularly, but not exclusively, the invention relates to a device for the collection of debris from an airfield or an airfield surface to prevent interference with aircraft.

BACKGROUND OF THE INVENTION

The following publications, for example, describe devices for collecting debris from a ground surface:

U.S. Pat. No. 5,284,211;

U.S. Pat. No. 8,250,696;

U.S. Pat. No. 8,839,878;

International Patent Application No. WO/1996/009440;

International Patent Application No. PCT/AU2005/000692;

International Patent Application No. PCT/AU1995/00629;

International Patent Application No. PCT/AU1998/00001;

International Patent Application No. PCT/AU2008/001252; and

International Patent Application No. PCT/AU2009/000149.

The disclosures of these publications are hereby incorporated by reference to form part of the disclosure of this application.

U.S. Pat. No. 5,284,211 and International Patent Application No. WO/1996/009440 disclose debris collection devices suitable, for example, for collecting small debris from a ground surface. These are each in the form of a mat-like structure having openings therethrough. The mat-like structure is laid on the ground surface and moved over the surface so the debris passes from the ground surface upwardly through the openings to rest on the upper surface of the structure. The device may then be moved to a suitable location at which the collected debris on the upper surface of the structure is removed, such as by up-ending the device. For example, the device of U.S. Pat. No. 5,284,211 has been found useful for clearing leaves from, and generally grooming, tennis courts, and the arrangement of WO/1996/009440 has been found useful for a variety of applications, including clearing debris such as bolts, screws, nuts washers and other foreign object debris, so called "FOD", from aircraft runways.

More particularly, these devices are generally in the form of a flexible mat having depending bristles. The mat has openings therethrough, and when the device is moved over a ground surface, debris on the surface, agitated by the bristles, tends to move upwardly through the openings to be deposited on upper collection surfaces of the device.

However, the applicant has determined that some collected material may be lost off the collection surfaces by sidewards sliding of the collected material along the collection surfaces until the collected material spills back onto the ground surface. This may occur particularly where the device is used to sweep debris from an endless part, which has substantial parts which are inclined transverse to the direction of travel of the device when sweeping debris (eg. a tilted road or runway surface). For example, cycle tracks generally have substantial banked parts which are higher at the outer side of the track than at the inner side. So, during sweeping, the collected material may slide to the lower side of a collection surface closest the inner side of the track, and hence slide off the collection surface at that side of it. This collected material may be re-deposited on the swept surface, decreasing collection efficiency.

Examples of the present invention seek to avoid or at least ameliorate the disadvantages of existing devices for the collection of debris.

SUMMARY OF THE INVENTION

A device for collecting debris from a ground surface, comprising a flexible generally planar member with an opening therethrough such that when the device is laid on and moved forwardly over the ground surface debris on the ground surface passes upwardly through the opening onto a collection surface of the device, the device having an inclined surface extending upwardly and rearwardly from a transverse edge which forms a rear edge of the opening, wherein the device further includes at least one retaining barrier extending at least partly across the collection surface such that at least part of the debris on the collection surface is retained from transverse movement along the collection surface by the retaining barrier.

In one form, the retaining barrier may overlap longitudinally with a longitudinal reinforcing rib of the device, the longitudinal reinforcing rib spanning said opening and serving as a transverse barrier to debris movement across the length of the opening.

In a preferred form, the retaining barrier is formed from an L-section of material. More preferably the retaining barrier is formed from an L-section of rubber material.

Preferably, the device further includes a transversely extending recess such that at least part of the debris passing upwardly through the opening to the collection surface progresses over said inclined surface by movement to the recess, capture in the recess, and, subsequently, movement from the recess to the collection surface. More preferably, the longitudinal retaining barrier extends at a forward end at least partially over the inclined surface. Even more preferably, the longitudinal retaining barrier extends rearwardly from said forward end at least partly over the collection surface. In one form, the longitudinal retaining barrier extends rearwardly from said forward end to a rearward end of the collection surface.

It is preferred that the device has a removable cover which is removably attached to the generally planar member at a forward location in front of the opening and at a rearward location behind the collection surface.

Preferably, the device includes a plurality of collection surfaces at locations which are spaced longitudinally along the length of the device, with each of the collection surfaces having a respective opening and a respective inclined surface. More preferably, only a forward-most one of the collection surfaces has a longitudinal retaining barrier.

In a preferred form, at least one longitudinal retaining barrier is located part-way along a transverse dimension of the collection surface.

Preferably, the collection surface has a plurality of longitudinal retaining barriers at locations spaced along a transverse dimension of the collection surface.

Preferably, each longitudinal retaining barrier is in the form of a baffle.

In a preferred form, the device includes a transverse frame structure defining said opening. More preferably, the frame structure defines a pair of openings separated by an intermediate longitudinal reinforcing rib positioned at a location intermediate lateral sides of the frame structure, and wherein a leading edge of the longitudinal retaining barrier is located forwardly of a trailing edge of the intermediate longitudinal reinforcing rib.

Preferably, the removable cover is formed of mesh material. More preferably, the removable cover, when attached, encloses a collection chamber which is defined by a lower boundary in the form of the collection surface, and at least one side boundary in the form of said longitudinal retaining barrier. Even more preferably, the collection chamber is defined by a pair of side boundaries in the form of a plurality of opposed longitudinal retaining barriers.

In one form, the collection chamber is further defined by a rear boundary where the cover is attached to the generally planar member, a ceiling in the form of an underside of the cover, and a front boundary in the form of a lip at a rear of the inclined surface.

BRIEF DESCRIPTION OF THE DRAWINGS

The invention is further described by way of non-limiting example only with reference to the accompanying drawings, in which.

DETAILED DESCRIPTION OF THE PREFERRED EMBODIMENTS

Figure 1:
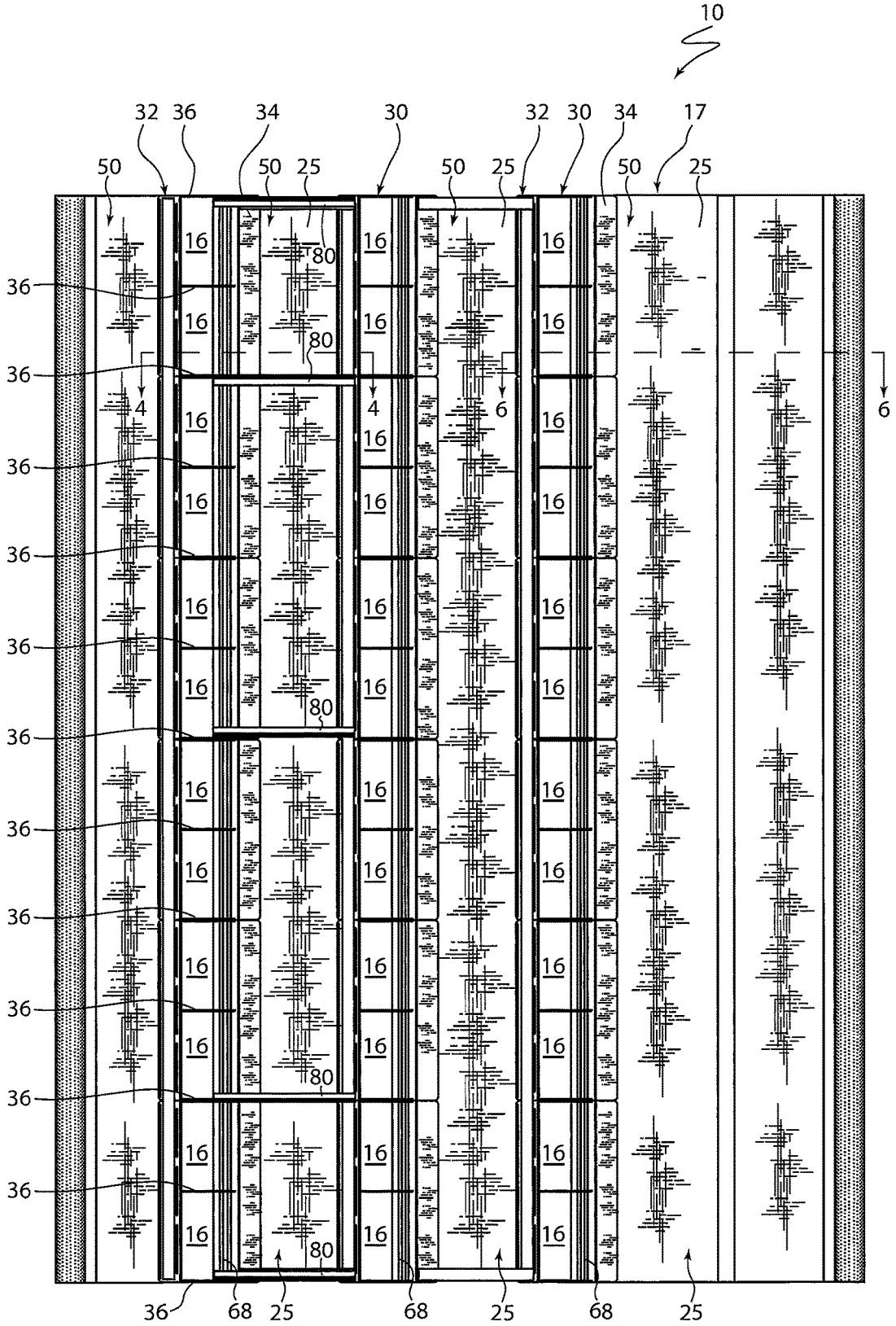
FIG. 1 is a top view of a debris collection device formed in accordance with the invention.

The debris collection device 10 shown in FIGS. 1 to 8 is generally of form described in international application PCT/AU2009/000149. As shown in the full top view in FIG. 1, the device 10 is formed as a flexible generally planar member 17 having sections 50 formed from conformable matting 15 having a flexible laminar base portion 12 with depending bristles 14. There are four sections 50 arranged at lengthwise spaced locations, separated by three transverse frame structures 30. The matting 15 is formed from inverted artificial grass material of the kind used for the surfaces of tennis courts and the like, arranged with the bristles extending downwardly, and, in use, lying on the ground surface 18 (see FIG. 4). In one particular alternative example, there may be six sections 50 arranged at lengthwise spaced locations, separated by five transverse frame structures 30. It will be understood by those skilled in the art that other numbers of sections and frame structures are possible within the scope of the invention.

Figure 2:
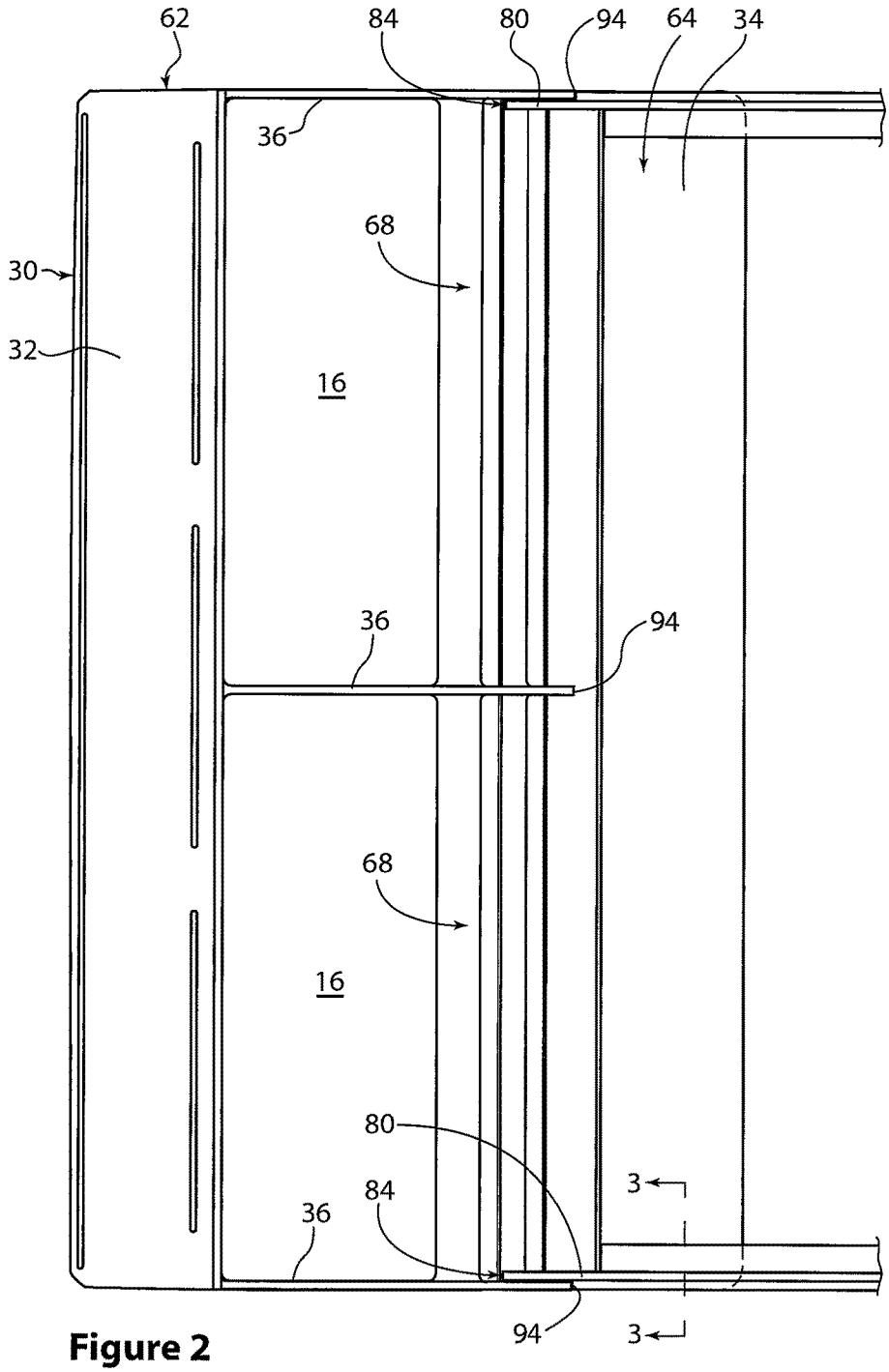
FIG. 2 is a plan view of a portion of a frame of the debris collection device of FIG. 1.
Figure 4:
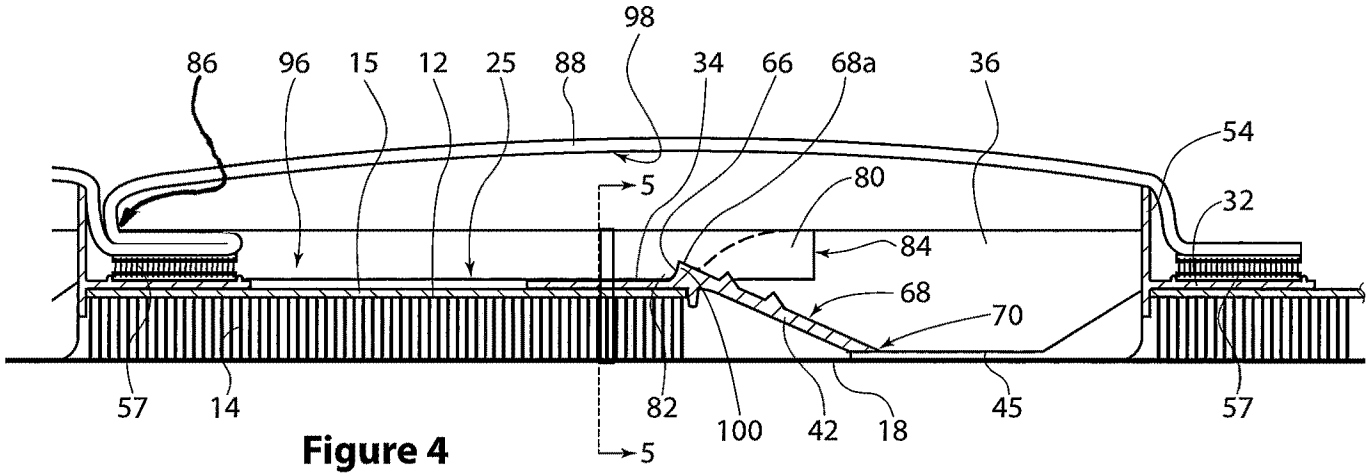
FIG. 4 is a partial longitudinal cross-sectional view taken along line 4-4 shown in FIG. 1.

The device 10 has rectangular sidewardly elongate openings 16, there being a respective transversely extending row of the openings 16 defined by each frame structure 30. When the device 10 is moved over the ground surface 18, by towing, the bristles 14 agitate loose debris such as leaves, stones and the like on the ground surface 18 by contact therewith and this debris tends to pass from the underside of the device 10 through the openings 16 to rest on upper collection surfaces 25 of sections 50. The action is facilitated by the presence of inclined pick-up surfaces 68 at the rear edges of the openings 16, these, particularly as shown in FIGS. 2 and 4, extending upwardly and rearwardly, from locations in use close to the ground surface 18, to the collection surfaces 25. The debris so directed to the collection surfaces 25 can then be conveniently taken away on the device 10 for disposal as desired.

In the illustrated embodiment, there are twelve openings 16 formed in each frame structure 30. Rows of the openings 16 in the frame structures 30 are respectively interposed, in the front-to-rear direction, between forward intermediate and rearward intermediate ones of the sections 50.

A leading frame structure 30 is secured at a transverse leading edge portion 32 thereof to a transverse trailing edge portion of a forward one of the sections 50, and at a trailing edge portion 34 to a leading edge portion of the forward intermediate one of the sections 50. A trailing frame structure 30 is secured at transverse leading and trailing edge portions 32, 34 respectively to a transverse trailing edge portion of the rearward intermediate section 50, and to a transverse leading edge portion of a trailing section 50.

Although the forward one of the sections 50 is forward of the front-most openings 16 and is therefore not a collection surface associated with a collecting opening 16, it may in fact still collect debris (eg. debris thrown up by the towing vehicle). As such, in one variation of the invention, retaining barriers may be provided on this forward most section 50 to prevent the sideways spill of debris from that section.

The frame structures 30 may for example be secured to the sections 50 by use of bolts or other fixture elements (eg. staples, adhesives, etc), which extend through the edge portions 32, 34 of the frame structures 30 and the matting material 15. Alternatively, the sections might for example be stitched to the edge portions 32, 34.

Edge portions 32, 34 are formed as respective forwardly and rearwardly extending parts of leading and, trailing transverse elements 62, 64 of the respective frame structure 30, and are generally coplanar. The edge portions 32, 34 overlie the respective adjacent upper edge portions of sections 50 to which they are secured.

The openings 16 in each frame structure 30 are defined between the leading and trailing transverse elements 62, 64 thereof and front to rear extending fin-like walls (or longitudinal reinforcing ribs) 36 of each frame structure. Ribs 36 extend between and interconnect the transverse elements 62, 64. There are, in the illustrated device 10, thirteen walls 36 for each frame structure 30, regularly spaced across the width of the frame structure 30. The ribs 36 are generally planar and vertically extending, and of relatively small thickness in the lateral direction of the device 10.

Each rib 36 has a lower edge portion 45 which in the in-use position of the device 10, is parallel to and either rests on or is just above the ground surface 18 (see FIG. 4). Each of the ribs 36 may have the same height or, alternatively, may have a variety of heights.

Trailing edges of the openings 16 of each frame structure 30 are defined by portions of the leading edge 70 of a transverse sloping pick-up portion 42 formed on the respective trailing transverse element 64. Each pick-up portion 42 has a front surface 68 that extends upwardly and rearwardly from the respective edge 70 at an acute angle to the ground surface 18. The pick-up portions join at the upper rear with forward parts of the portions 34 of the respective transverse element 64. The upper part of each pick-up portion 42 defines an upstanding wall 66 which terminates a short distance above the upper surface of the trailing edge portion 34 of the respective frame structure 30, and thus also a short distance above the upper surface 25 of the following section 50. Each wall 66 has an upwardly and rearwardly extending sloping front surface 68*a* forming a continuation of the sloping upper surface 68 of the respective pick-up portion 42. The upper edge of each surface 68*a* terminates at an apex 73 of the respective wall 66, which can itself vary in height. A rear surface 78 of each wall 66 extends downwardly from apex 73 to the edge portion 34 of the respective frame structure 30.

Each forward transverse element 62 has an upstanding wall 54 (see FIG. 4). Wall 54 has a generally upright part extending upwardly from the rear edge of portion 32. At the upper rear margin of the rearmost section 50, there is provided a side to side hook-and-loop fastener 57, which may be provided for attaching a removable cover to contain caught debris within the device 10. Other hook-and-loop fasteners 57 are also provided in front of each upstanding wall 54 so as to contain the space above the respective collection surface 25.

The walls 54 and hook-and-loop fastener cover attachments 57 present barriers serving to inhibit rearward movement of collected debris off the mat sections 50 during use of the device 10, so as to lessen loss of collected material from the device 10. That is, as collected debris accumulates on the surfaces 25, there is a tendency for this debris to move rearwardly, due to the continuing forward movements of the device 10, and the walls 54 and cover attachments 57 restrict movement of the collected debris back over the rear edges of the collection surfaces 25. The walls 66 serve to inhibit forward movement of collected debris from the intermediate and rear mat sections 50 from passing forwardly back into the openings 16 immediately in front thereof, during deceleration of the device 10 as it is used. In particular, under deceleration, during forward movement of device 10, resultant forward movement of the collected debris along collection surfaces 25, is at least in part obstructed by piling up of the debris against the upstanding wall surfaces. On the other hand, the sloping front surfaces 68*a* of the walls 66 facilitate flow of debris picked up by the device to pass upwardly and rearwardly along the pick-up portions 42, upwardly and rearwardly to clear the apexes 73 of the walls 66 to fall and be collected on the collection surfaces 25 of the intermediate and rear mat sections 50. This movement of debris along surface 68 of pick-up portions 42 and over the adjacent wall 66 is facilitated by the angle of slope of the inclined pick-up surfaces 68. The walls 66 form respective barriers to impede forward movement of collected debris, while permitting rearward flow thereover to the collection surfaces 25.

The described device 10 has been found to be particularly satisfactory for cleaning debris from hard surfaces such as asphalt, concrete or the like, as well as from grass and similar surfaces. It has also been found satisfactory for use in collecting small items such as nuts, bolts or the like such as from aircraft runways. With rough asphalt in particular, the collecting action is very efficient, the bristles 14 acting to clean the ground surface, directing debris to the collection surfaces 25 of the device 10.

In one form of the invention, it was found satisfactory to provide openings 16 of dimensions of the order of 260 mm by 60 mm width in front rear length, with the depth of the pile formed by the bristles 14 being of the order of 1 cm. The sizes may however be varied as necessary to adapt the invention to particular uses. For example, the openings 16 may be of the order of 10 to 300 mm length, measured in the front to rear direction of the device of the invention. At towing speeds of up to 30 kilometres per hour (kph), a length of about 70 mm may be satisfactory, with greater lengths being employed with faster towing speeds, for example 100 mm where speeds up to 100 kph are employed. Similarly, the depth of the pile provided by the bristles 14 may be varied. Generally, the longer the bristles, the better is the wearability, but shorter bristles are generally more efficient, since it is easier to direct objects through a lesser distance from the ground surface to the upper surface of the device. Therefore, shorter bristles will likely result in a device which is able to achieve satisfactory results at relatively slower towing speeds. Practically, for small objects such as washers or the like a pile thickness of about 9 mm may be satisfactory. For large objects, greater depth may be employed. A choice of overall thickness of matting material of 5 to 15 mm will provide satisfactory pick-up of a range of commonly encountered small objects. The bristles 14 should generally be flexible, and some degree of resilience is also desirable.

In an exemplary construction, the matting material 15 was artificial grass material, the bristles 14 being formed of polypropylene fibres and about 10 mm in length. The resultant mat-like structure is crushable by impression of hand pressure on the bristles (i.e. upwardly crushable), but has sufficient resilience to cause reasonably quick restoration to the original condition when pressure is removed. This artificial grass material is relatively flexible, the base material being flexible.

The described artificial matting material presents an under-surface constituted by the bristles which is readily able to conform to local variations in ground surface as the device 10 is passed over the ground surface, in particular being able to conform to surface undulations as well as accommodating small obstacles, and providing an effective sweeping action to agitate debris and cause it to move through the openings 16. While it is preferred that the device include a flexible base with a conformable portion in the form of the described bristles, other constructions are possible. For example, a layer of foamed plastics material could be used. In general, the whole of the device 10 should be flexible, although, particularly if a very thick under layer constituted by bristles, foam or other material is employed, this could be secured to a relatively rigid upper backing. The leading edge of the device may be provided with a rigid element to facilitate maintenance of the device in a spread out condition during towing over a surface.

The configuration and height of the wall 66 may be chosen to suit that particular kind of debris to be collected. For general use, a height of between 5-25 mm may be useful.

In general, the height may be greater for larger types of material to be collected and smaller for smaller types of material. That is, smaller types of material may have lesser forward momentum when collected, so that forward movement under deceleration of the device may be more easily resisted. Also, the relatively greater momentum of heavier material when passing upwardly from openings 16 may enable them to be efficiently carried rearwardly over a higher barrier 66.

Figure 5:
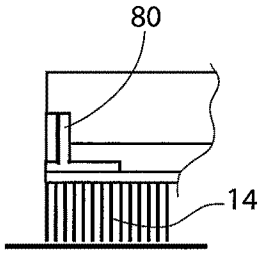
FIG. 5 is a partial transverse cross-sectional view taken along line 5-5 shown in FIG. 4.

As shown in FIG. 4 and FIG. 5, the walls 66 forming barriers preferably join to the respective edge portions 34 at respective radiused filet portions 82, so that the rear surfaces 78 of walls 66 merge smoothly with the upper surface of the respective portion 34. By this, root portions of the walls 66 are of greater width viewed in transverse section as in FIG. 4, and there is no sharp corner between these surfaces. This aids in strengthening the walls 66. Also, the arrangement assists by inhibiting catching of debris in the corners between surfaces 78 and surfaces of edge portion 34, when the device 10 is lifted to shake debris forwardly and out of the device 10.

In general, the dimension of the openings 16 in the front to rear direction of the device may be roughly the same as the front to rear lengths of the sections 50. The device may be of any convenient dimensions. A length of the order of 1.5 metre and a width of the order of 2.4 metres may be satisfactory for general manual use.

With regard to the present invention, the applicant has determined that there are potential inefficiencies of existing devices for removing debris from a ground surface, particularly where the ground surface is tilted transversely (eg. cambered) to the direction of movement of the device, in which case the applicant has identified that there can be a tendency for collected debris to gather down into a lower edge of the collection surface such that the debris may spill back through the openings and onto the ground surface. In order to address this, the applicant has developed a new and inventive device which includes barriers, or baffles, to prevent the unwanted gathering of collected debris due to gravity or other influence (such as cornering and momentum of the debris during cornering).

More specifically, with reference to FIGS. 1 to 8, the applicant has developed a device 10 for collecting debris from a ground surface 18, comprising a flexible generally planar member 17 with an opening 16 therethrough such that when the device is laid on and moved forwardly over the ground surface 18 debris on the ground surface 18 passes upwardly through the opening 16 onto a collection surface 25 of the device 10. The device 10 has an inclined surface 68 extending upwardly and rearwardly from a transverse edge 70 which forms a rear edge of the opening 16. Significantly, the device 10 includes at least one longitudinal retaining barrier 80 extending at least partly across the collection surface 25 such that at least part of the debris on the collection surface 25 is retained against transverse movement along the collection surface 25 by the longitudinal retaining barrier 80.

As shown in FIGS. 1, 2, 4 and 7, the retaining barrier 80 overlaps longitudinally with a longitudinal reinforcing rib 36 of the device 10, the longitudinal reinforcing rib 36 spanning said opening 16 and serving as a transverse barrier to debris movement across the length of the opening 16.

Figure 3:
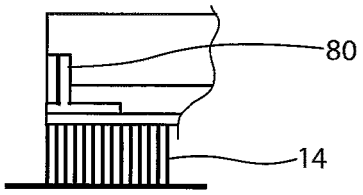
FIG. 3 is a partial transverse cross-sectional view taken along line 3-3 shown in FIG. 2.

The retaining barrier 80 may be formed from an L-section of material (see FIG. 3). In particular, the retaining barrier 80 may be formed from an L-section of rubber material so that the retaining barrier is able to deform, for example if necessary to avoid breakage or damage to the device 10. Flexible rubber also enables the device to be rolled up or folded. Of course, a rigid material could be used for the retaining barriers however that would result in limitations as to the flexibility of the device.

Figure 6:
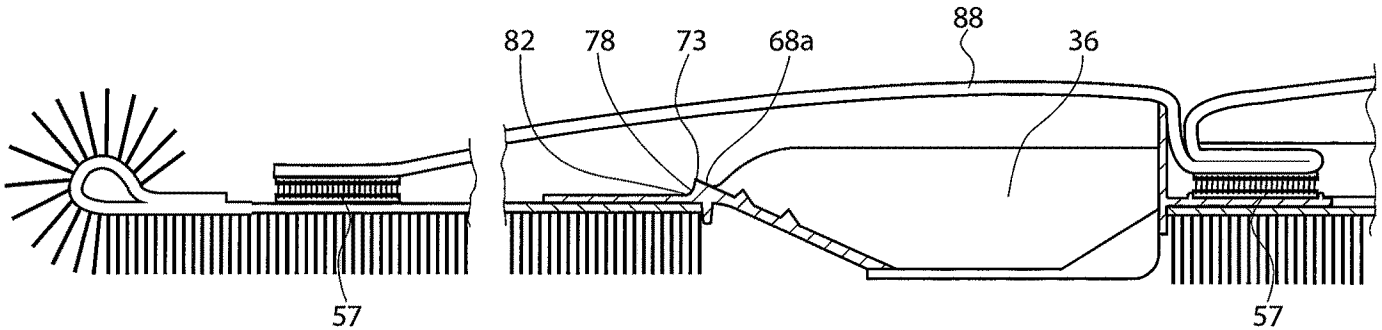
FIG. 6 is a partial longitudinal cross-sectional view taken along line 6-6 shown in FIG. 1.
Figure 7:
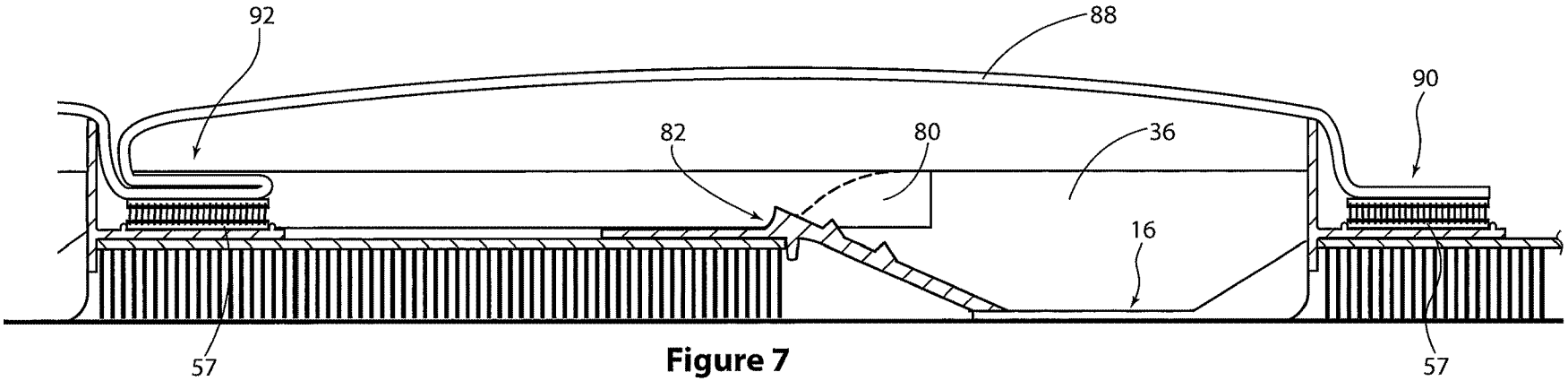
FIG. 7 is a partial cross-sectional view similar to the view shown in FIG. 4.
Figure 8:
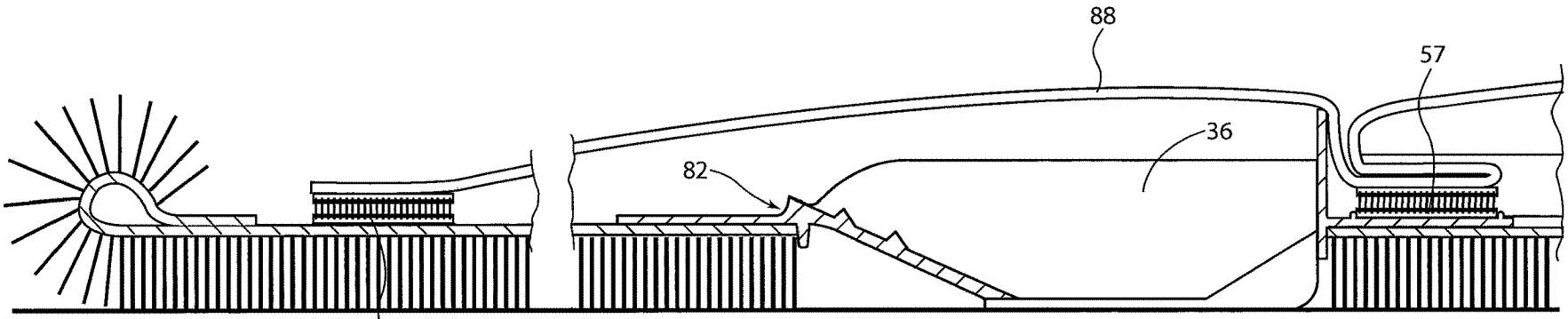
FIG. 8 is a partial cross-sectional view similar to the view shown in FIG. 6 but with the debris collection device shown resting on a ground surface.
Figure 9:
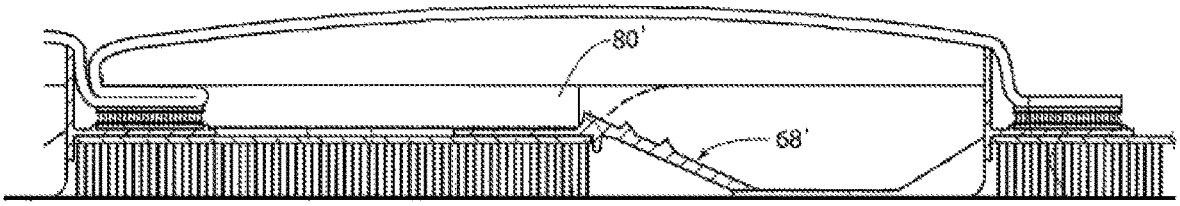
FIG. 9 is a partial longitudinal cross-sectional view of another debris collection device formed in accordance with the present disclosure.

As shown in FIGS. 4 and 6, the device 10 includes a transversely extending recess 82 such that at least part of the debris passing upwardly through the opening 16 to the collection surface 25 progresses over said inclined surface 68 by movement to the recess 82, capture in the recess 82, and, subsequently, movement from the recess 82 to the collection surface 25.

The longitudinal retaining barrier 80 extends at a forward end 84 (see FIG. 4) at least partially over the inclined surface 68, thus ensuring that the longitudinal retaining barrier 80 prevents unwanted gathering of collected debris right from the front of the collection surface 25. As can be seen in FIGS. 1 and 4, the longitudinal retaining barrier 80 extends rearwardly from said forward end 84 at least partly over the collection surface 25 and, more preferably, from the forward end 84 to a rearward end 86 of the collection surface 25. In an alternative example (FIG. 1)) which is a variation to the debris collection device shown in FIG. 4 where like reference numerals with the addition of the prime (') symbol indicate like features, the retaining barrier 80' terminates at its forward end rearward of the inclined surface 68'.

Also to prevent spilling of collected debris back onto the ground surface 18, the device 10 has a removable cover 88 which is removably attached to the generally planar member 17 at a forward location 90 in front of the opening 16 and at a rearward location 92 behind the collection surface 25.

The device 10 includes a plurality of collection surfaces 25 (see FIG. 1) at locations which are spaced longitudinally along the length of the device 10, with each of the collection surfaces 25 having a respective opening 16 and a respective inclined surface 68. In the example shown, only a forward-most one of the collection surfaces 25 has a longitudinal retaining barrier 80, as it is the forward-most collection surface which tends to fill up with debris the most and is therefore in greatest need of the barrier to prevent unwanted gathering of the debris. Alternatively, more than one or even all of the collection surfaces 25 may be provided with retaining barriers 80.

As shown in FIG. 1, there are three internal longitudinal retaining barriers 80, each of which is located part-way along a transverse dimension of the collection surface 25. The collection surface has a three longitudinal retaining barriers 80 at locations spaced along a transverse dimension of the collection surface 25, with an additional longitudinal retaining barrier at each side of the collection surface 25 so that there is a total of five longitudinal retaining barriers 80 across the width of the collection surface 25.

Each longitudinal retaining barrier 80 resembles a baffle, being for deflecting solid debris in a similar manner to the way in which a typical baffle deflects fluids or gas.

The device 10 includes a transverse frame structure 30 defining the opening 16. The frame structure 30 defines a pair of openings 16 (see detail in FIG. 2) separated by an intermediate longitudinal reinforcing rib 36 positioned at a location intermediate lateral sides of the frame structure 30. A leading edge of the longitudinal retaining barrier 84 is located forwardly of a trailing edge 94 of the intermediate longitudinal reinforcing rib 36. The longitudinal retaining barrier 80 may be adjacent to the intermediate longitudinal reinforcing rib 36 so that they abut and form a continuous barrier, as shown in FIG. 2. In other possible practical embodiments the longitudinal retaining barrier 80 may terminate rearward of the reinforcing rib 36 so that there is no overlap.

With reference to FIGS. 4, 6 7 and 8, the removable cover 88 may be formed of mesh material so that air (but not debris) can pass through the cover 88. The removable cover 88, when attached, encloses a collection chamber 96 which is defined by a lower boundary in the form of the collection surface 25, and at least one side boundary in the form of said longitudinal retaining barrier 80. In the example shown in the drawings, the collection chamber 96 is defined by a pair of side boundaries in the form of a plurality of opposed longitudinal retaining barriers 80, and is further defined by a rear boundary where the cover 88 is attached to the generally planar member 17 (by the hook and loop fastener 57), a ceiling 98 in the form of an underside of the cover 88, and a front boundary in the form of a lip 100 at a rear of the inclined surface 68.

Advantageously, the longitudinal retaining barriers 80 prevent passage of the collected debris along the collection surface 25 to retain a relatively even distribution of collected debris along the width of the collection surface and to prevent an excessive amount of debris collecting at one side of the collection surface 25 which the applicant has determined can lead to spillage of the collected debris back onto the ground surface 18. Also advantageously, the longitudinal retaining barriers 80 cooperate with the removable cover 88 to form a collection chamber 96 for retaining the collected debris inside the device 10.

The described construction has been advanced merely by way of example and many modifications and variations may be made without departing from the spirit and scope of the invention, which includes every novel feature and combination of features herein disclosed.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge.

The claims defining the invention are as follows:

1. A device for collecting debris from a ground surface, comprising:

a flexible generally planar member with an opening therethrough, such that when the device is laid on and moved forwardly over the ground surface, debris on the ground surface passes upwardly through the opening onto a collection surface of the device, an inclined surface extending upwardly and rearwardly from a transverse edge, which forms a rear edge of the opening, to the collection surface, wherein the inclined surface and the collection surface are different surfaces, and at least one retaining barrier extending from a forward end of the retaining barrier and at least partly across the collection surface, the forward end being at least partially over the inclined surface or being rearward of the inclined surface, such that at least part of the debris on the collection surface is retained from transverse movement along the collection surface by the retaining barrier.

2. A device for collecting debris as claimed in claim 1, wherein the retaining barrier overlaps longitudinally with a longitudinal reinforcing rib of the device, the longitudinal reinforcing rib spanning said opening and serving as a transverse barrier to debris movement across the length of the opening.

3. A device for collecting debris as claimed in claim 1, wherein the retaining barrier is formed from an L-section of material.

4. A device for collecting debris as claimed in claim 3, wherein the retaining barrier is formed from an L-section of rubber material.

5. A device for collecting debris as claimed in claim 1, wherein the device further includes a transversely extending recess such that at least part of the debris passing upwardly through the opening to the collection surface progresses over said inclined surface by movement to the recess, capture in the recess, and, subsequently, movement from the recess to the collection surface.

6. A device for collecting debris as claimed in claim 1, wherein the retaining barrier extends rearwardly from said forward end to a rearward end of the collection surface.

7. A device for collecting debris as claimed in claim 1, wherein the device has a removable cover which is removably attached to the generally planar member at a forward location in front of the opening and at a rearward location behind the collection surface.

8. A device for collecting debris as claimed in claim 1, wherein the device includes a plurality of collection surfaces at locations which are spaced longitudinally along the length of the device.

9. A device for collecting debris as claimed in claim 8, wherein only a forward-most one of the collection surfaces has at least one retaining barrier.

10. A device for collecting debris as claimed in claim 1, wherein the retaining barrier is located part-way along a transverse dimension of the collection surface.

11. A device for collecting debris as claimed in claim 1, wherein the collection surface has a plurality of retaining barriers at locations spaced along a transverse dimension of the collection surface.

12. A device for collecting debris as claimed in claim 1, wherein each retaining barrier is in the form of a baffle.

13. A device for collecting debris as claimed in claim 1, wherein the device includes a transverse frame structure defining said opening.

14. A device for collecting debris as claimed in claim 13, wherein the frame structure defines a pair of openings separated by an intermediate longitudinal reinforcing rib positioned at a location intermediate lateral sides of the frame structure, and wherein a leading edge of the retaining barrier is located forwardly of a trailing edge of the intermediate longitudinal reinforcing rib.

15. A device for collecting debris as claimed in claim 7, wherein the removable cover is formed of mesh material.

16. A device for collecting debris as claimed in claim 7, wherein the removable cover, when attached, encloses a collection chamber which is defined by a lower boundary in the form of the collection surface, and at least one side boundary in the form of said retaining barrier.

17. A device for collecting debris as claimed in claim 16, wherein the collection chamber is defined by a pair of side boundaries in the form of a plurality of opposed retaining barriers.

18. A device for collecting debris as claimed in claim 17, wherein the collection chamber is further defined by a rear boundary where the cover is attached to the generally planar member, a ceiling in the form of an underside of the cover, and a front boundary in the form of a lip at a rear of the inclined surface.

19. A device for collecting debris as claimed in claim 1, wherein the retaining barrier is longitudinal in that its length has a component extending parallel to a direction of travel of the device.

20. A device for collecting debris as claimed in claim 1, wherein the retaining barrier extends parallel to the direction of travel of the device.

21. A device for collecting debris from a ground surface, comprising a flexible generally planar member with an opening therethrough such that, when the device is laid on and moved forwardly over the ground surface, debris on the ground surface passes upwardly through the opening onto a collection surface of the device, the device having an inclined surface extending upwardly and rearwardly from a transverse edge, which forms a rear edge of the opening, to the collection surface, wherein the inclined surface and the collection surface are different surfaces, wherein the device further includes at least one retaining barrier extending at least partly across the collection surface such that at least part of the debris on the collection surface is retained from transverse movement along the collection surface by the retaining barrier, wherein the at least one retaining barrier includes a retaining barrier that is located part-way along a transverse dimension of the collection surface.

* * * * *